US008511805B2

(12) United States Patent
Henn et al.

(10) Patent No.: US 8,511,805 B2
(45) Date of Patent: Aug. 20, 2013

(54) EXTRACTING LIQUID FROM A CARTRIDGE

(75) Inventors: Nissim Henn, Nes Ziona (IL); Boris Livshitz, Rishon Le Zion (IL); Chen Talmor, Givat ada (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 13/338,774

(22) Filed: Dec. 28, 2011

(65) Prior Publication Data

US 2013/0169722 A1 Jul. 4, 2013

(51) Int. Cl.
*B41J 2/175* (2006.01)

(52) U.S. Cl.
USPC ..... 347/87; 347/86

(58) Field of Classification Search
USPC ..... 347/86, 87
See application file for complete search history.

(56) References Cited

U.S. PATENT DOCUMENTS

| | | | | |
|---|---|---|---|---|
| 2,558,900 | A * | 7/1951 | Hooper | 101/219 |
| 3,870,200 | A | 3/1975 | Spatz | |
| 4,119,034 | A * | 10/1978 | Wax | 101/366 |
| 4,852,772 | A | 8/1989 | Ennis, III | |
| 5,314,092 | A | 5/1994 | Jacobsen | |
| 6,149,267 | A * | 11/2000 | Geissmann | 347/87 |
| 6,361,606 | B1 | 3/2002 | Jairazbhoy | |
| 6,382,472 | B1 | 5/2002 | Shoval | |
| 6,419,351 | B1 | 7/2002 | Lawson | |
| 6,725,769 | B1 | 4/2004 | Williams | |
| 2005/0243150 | A1 * | 11/2005 | Ghisalberti et al. | 347/86 |

FOREIGN PATENT DOCUMENTS

WO WO00/61489 A1 10/2000

* cited by examiner

*Primary Examiner* — Matthew Luu
*Assistant Examiner* — Alexander D Shenderov

(57) ABSTRACT

A drive assembly has a moveable drive head, which is able to engage a plunger in a cartridge containing a liquid. The cartridge has a plunger moveable by the drive head to extract the liquid from the cartridge.

21 Claims, 4 Drawing Sheets

EXTRACTING LIQUID FROM A CARTRIDGE

BACKGROUND

A printer system can include an ink cartridge (or multiple ink cartridges) that contain(s) printer ink for use in printing onto substrates (e.g. paper, poster, transparency, etc). The printer system includes a mechanism to extract printer ink from each ink cartridge. The extracted printer ink is then delivered by a delivery assembly to a substrate to print a target pattern on the substrate.

BRIEF DESCRIPTION OF THE DRAWINGS

Some embodiments are described with respect to the following figures.

DETAILED DESCRIPTION

An ink cartridge for use in a printer system includes a container that contains printer ink. During use, the printer ink in the ink cartridge can be extracted from an output port of the ink cartridge. Multiple ink cartridges provided in a printer system can contain printer ink of different colors.

In certain types of printer systems, the printer ink can be relatively viscous (have a viscosity greater than some predefined threshold). An example of such printer system is a Hewlett-Packard Indigo press system that employs printer ink that has relatively small solid color particles suspended in an oil (referred to as an imaging oil). An example imaging oil is an isoparaffinic fluid, such as Isopar™ fluid. In other examples, color particles can be suspended in other types of dispersion liquids. The viscosity of the printer ink used in a Hewlett-Packard Indigo press system depends upon the concentration of the solid color particles suspended in liquid. A higher concentration on the solid color particles in the ink cartridge leads to more viscous printer ink.

Note that the reference to Hewlett-Packard Indigo press systems is provided for purposes of example. Techniques or mechanisms according to some implementations can be used in other types of printer systems.

It can be challenging to fully extract relatively viscous ink from an ink cartridge in a uniform manner. The challenge becomes greater as the inner ink-containing volume of the ink cartridge increases. With traditional techniques or mechanisms of extracting printer ink from an ink cartridge, residual amounts of viscous printer ink can remain in the ink cartridge, which can lead to inefficient use of the ink cartridge.

In accordance with some implementations, techniques or mechanisms are provided to allow for more effective and uniform extraction of relatively viscous printer ink from an ink cartridge. By using such techniques or mechanisms, larger ink cartridges (with larger ink-containing volumes) can be employed to increase the printing capacity of a printer system.

Although reference is made to printer systems and printer ink cartridges in the ensuing discussion, it is noted that techniques or mechanisms according to some implementations can also be applied in another type of system that employs a cartridge containing another type of viscous liquid that includes liquid in which solid particles are suspended.

Figure 1:
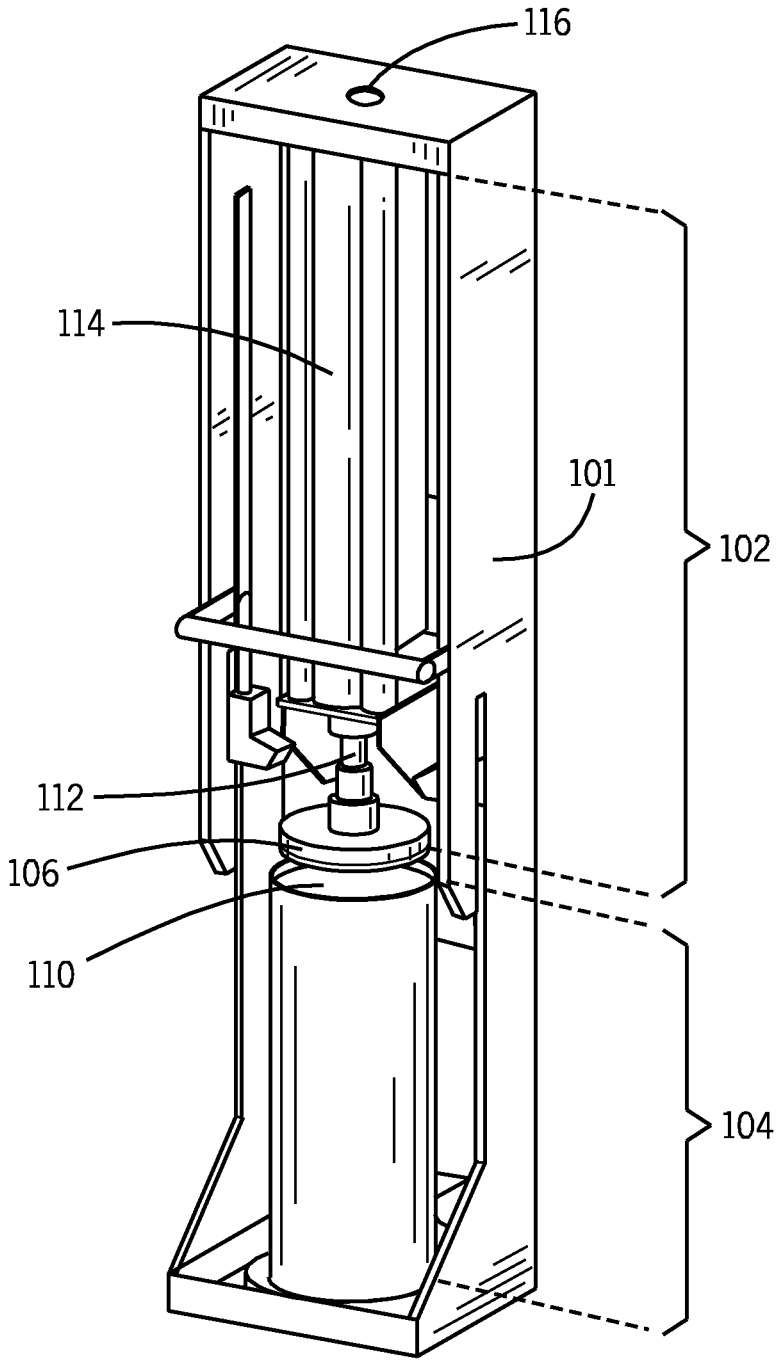
FIG. 1 is a perspective view of an arrangement that has a drive assembly and an ink cartridge according to some implementations.

In some implementations, a drive assembly is provided in a printer system for applying a force on a moveable plunger of an ink cartridge to more effectively extract printer ink from an ink cartridge. An example arrangement according to some implementations is shown in FIG. 1, which depicts a drive assembly 102 and an ink cartridge 104. In examples according to FIG. 1, the drive assembly 102 and ink cartridge 104 are positioned inside a support frame 101—in other examples, the support frame 101 can be used to house multiple drive assemblies and respective ink cartridges. The ink cartridge 104 can be formed of a plastic or other material.

The drive assembly 102 has a drive head 106 that is used for engaging a cartridge plunger 110 in the ink cartridge 104. The drive head 106 can be formed of a relatively soft material, such as a material including elastomer. The plunger 110 can be formed of a relatively soft material, such as a material including elastomer. The ink cartridge 104 includes a container in which printer ink is contained. Downward movement of the cartridge plunger 110 due to a force applied by the drive head 106 causes delivery of printer ink from a nozzle (not shown in FIG. 1) at a lower end of the ink cartridge 104.

The drive assembly 102 further includes a drive rod 112. The lower end of the drive rod 112 is attached to the drive head 106. A piston (discussed further below in connection with FIG. 2) is provided inside a chamber defined by an outer housing 114 of the drive assembly 102. The piston is movable by application of pneumatic pressure above the piston, such as due to application of pressurized gas (e.g. air) through a gas input port 116 that delivers gas into the upper portion of the chamber of the drive assembly housing 114.

In other examples, the piston in the drive assembly 102 can be driven by hydraulic pressure (due to application of pressurized liquid), or by a mechanical force (e.g. due to mechanical force applied by a motor). More generally, the piston in the drive assembly 102 is an actuating member that is moveable due to application of an input force.

Figure 2:
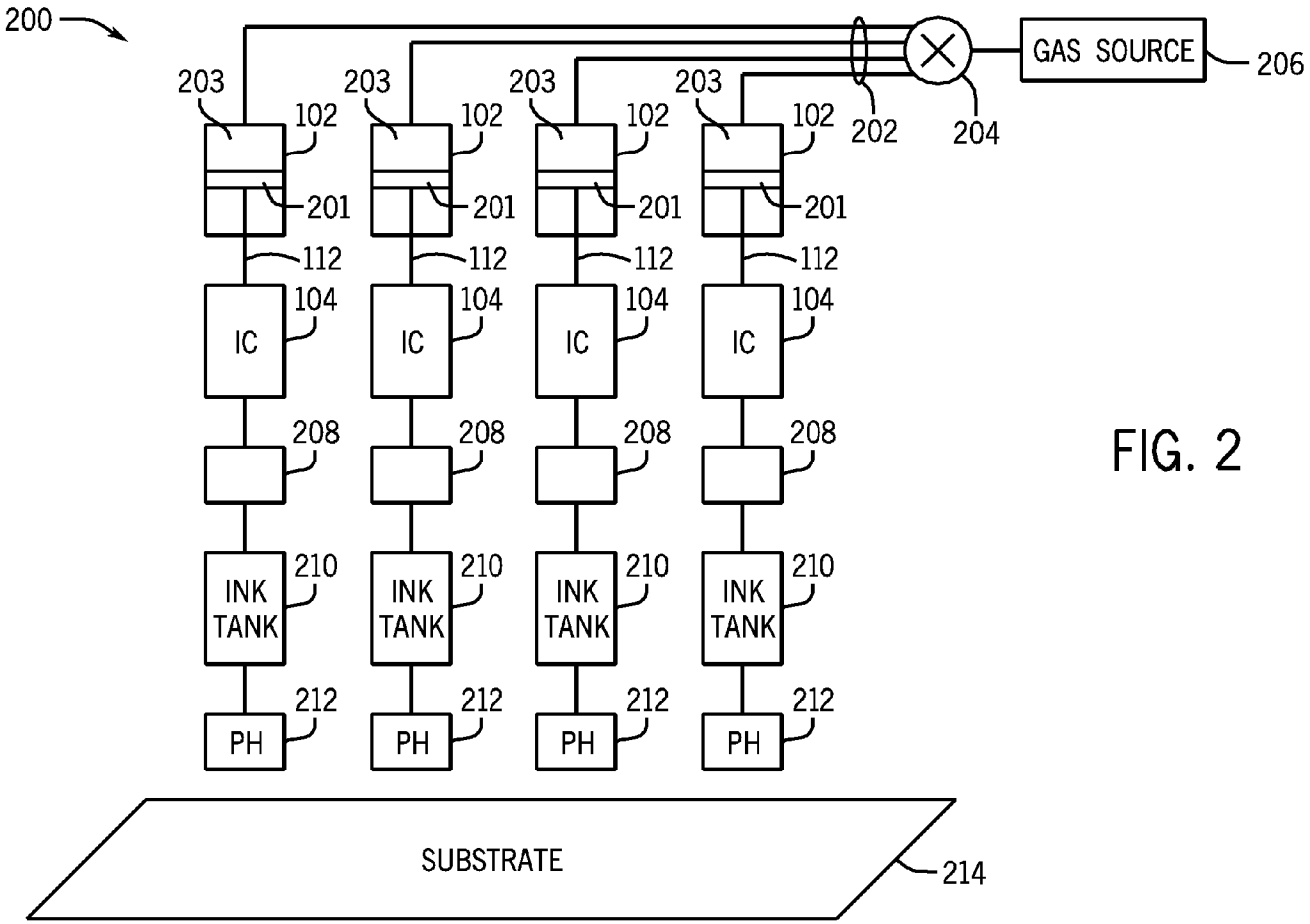
FIG. 2 is a block diagram of a portion of an example printer system incorporating drive assemblies and ink cartridges, in accordance with some implementations.

FIG. 2 is a schematic view of an example printer system 200 that has multiple ink cartridges 104 (containing printer ink of different colors, for example) and corresponding drive assemblies 102. Note that FIG. 2 is intended to schematically illustrate some components that may be present in the printer system 200—there may be other components not shown. The drive assemblies 102 are connected to respective pneumatic lines 202 for delivery of pressurized gas from a gas source 206 through a valve assembly 204 that can have various valves. The valves in the valve assembly 204 can be controlled to open and close—when in an open position, a valve allows gas from the gas source 206 to be delivered through the corresponding pneumatic line 202 to the corresponding drive assembly 102.

The pressurized gas delivered into an inner chamber 203 of each drive assembly 102 is able to drive a moveable piston 201 inside the drive assembly 102. The piston 201 is connected to a respective drive rod 112 (also shown in FIG. 1). The pressurized gas delivered into the inner chamber 203 applies a downward force on the piston 201 to push the piston 201 downwardly, which in turn moves the respective drive rod 112 of the drive assembly 102 downwardly to move the plunger 110 (FIG. 1) in the corresponding ink cartridge 104. The downward movement of the plunger 110 in the ink cartridge 104 causes printer ink to be extracted from the ink cartridge 104.

More generally, the piston is an actuating member that is moveable in response to an input force, such as pneumatic pressure, hydraulic pressure, or mechanical force.

The printer ink that is extracted from each ink cartridge 104 is passed through a corresponding ink flow subsystem 208 for delivery to a respective ink tank 210. The ink flow subsystem 208 can include various components, including a mixing tank (to mix the printer ink extracted from the ink cartridge 104, such as by adding liquid to dilute the printer ink). The ink flow subsystem 208 in some examples can also include a pump and corresponding valve for controlling flow of the printer ink to the respective ink tank 210. In other examples, the mixing tank and/or the pump can be omitted from the ink flow subsystem 208.

The printer ink from the various ink tanks 210 can then in turn be delivered through corresponding printheads 212 onto a substrate 214 (e.g. paper, poster, transparency, etc.). In this manner, a target print pattern can be printed on the substrate 214. Effectively, the ink flow subsystem 208, ink tank 210, and printhead 212 are part of an example ink delivery assembly for delivering printer ink from an ink cartridge 208 to the substrate 214. In other examples, other implementations of an ink delivery assembly can be employed for delivering printer ink extracted from an ink cartridge to a substrate.

Figure 3:
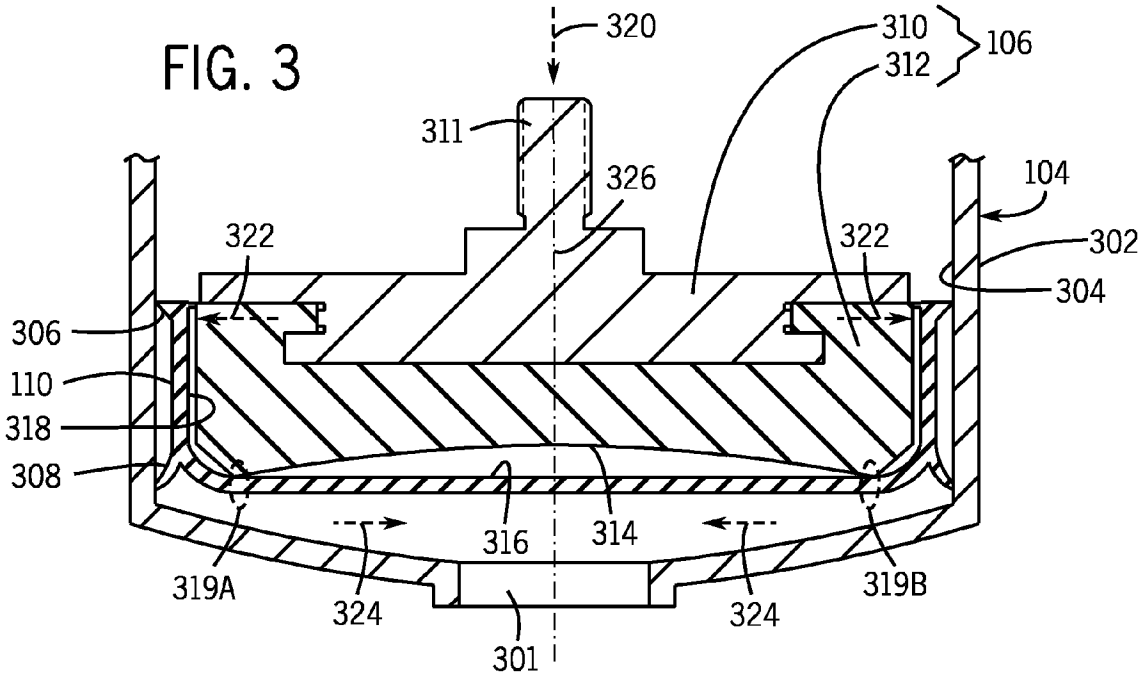
FIG. 3 is a cross-sectional view of portions of a drive assembly and ink cartridge, according to some implementations.

FIG. 3 is a cross-sectional view of portions of the drive assembly 102 and the ink cartridge 104. FIG. 3 shows a portion of an outer housing 302 of the ink cartridge 104. The outer housing 302 forms a container of the ink cartridge 104. The cartridge plunger 110 is shown in a lowered position inside a chamber 304 defined by the ink cartridge outer housing 302. The plunger 110 has been moved to its lowered position by downward movement of the drive head 106.

The plunger 110 has a sealing lips 306 and 308 to seal against the inner wall of the ink cartridge outer housing 302. The plunger sealing lips 306 and 308 when sealingly engaged to the inner wall of the ink cartridge outer housing 302 prevents printer ink from leaking from a lower portion of the ink cartridge 104 past the plunger 110 to an upper portion of the ink cartridge 104, as the plunger 110 is pushed downwardly by the drive head 106.

In accordance with some implementations, the drive head 106 includes a rigid core 310, which can be formed of a relatively sturdy material such as metal or other material. In addition, the drive head 106 has a gasket 312 that is attached to the rigid core 310. The gasket 312 is positioned below the rigid core 310. A bottom surface 314 of the gasket 312 is arranged to engage with a mating (upper) surface 316 of the plunger 110. In examples according to FIG. 3, the plunger 110 defines a receptacle 318 for receiving at least a portion of the drive head 106; as depicted, the drive head gasket 312 is positioned inside the plunger receptacle 318.

In some examples, the drive head gasket 312 is formed of material that includes an elastomer. Examples of an elastomer include polyurethane, flouropolymer elastomer, rubber, and so forth. In other examples, the drive head gasket 312 can be formed of other materials.

In accordance with some implementations, the bottom surface 314 of the drive head gasket 312 is concave in shape when viewed from below the gasket. In some examples the mating surface 316 of the plunger 110 is generally planar, such that contact between the gasket 312 and the mating surface 316 of the plunger 110 occurs at locations 319A and 319B. However, the mating surface 316 of the plunger 110 can have other shapes in other examples—one such other shape is discussed further below in connection with FIG. 4.

The drive head rigid core 310 has an attachment member 311 that is for attaching to the drive rod 112 depicted in FIG. 1. In some examples, the external surface of the attachment member 311 can have a thread profile to allow for threading engagement with the drive rod 112. In other examples, the attachment member 311 can be engaged to the drive rod 112 using another type of attachment mechanism, such as by using a screw, nut and bolt mechanism, and so forth.

In operation, a downward compression force is applied on the drive head 106 as indicated by arrow 320. This downward compression force 320 on the drive head 106 imparts an outward radial force (indicated by arrows 322) against the plunger 110. This outward radial force applied against the plunger 110 improves sealing engagement between the sealing lip 306 of the plunger 110 and the inner wall of the ink cartridge outer housing 302.

Initially, when the plunger 110 is located at an elevated position in the chamber 304 of the ink cartridge 104, the downward compression force (320) causes most of the force to be applied at locations 319A and 319B in FIG. 3. However, once the plunger 110 has moved down to its lowered position, as shown in FIG. 3, and after most of the printer ink has been extracted from the ink cartridge 104 through an output nozzle 301, continued downward compression force (320) causes the pressure applied by the plunger 110 against the remaining printer ink to move towards the center line 326 of the ink cartridge 104, as indicated by arrows 324. Such inward pressure indicated by arrows 324 is due to the concave shape of the bottom surface 314 of the drive head gasket 312. The concave shape of the bottom surface 314 produces a pressure wavefront that moves towards the center line 326 of the ink cartridge 104 when the ink cartridge 104 is almost empty.

The ability to apply inward pressure provides a squeeze effect against remaining portions of printer ink as the plunger 110 is moved to its lowered position allows for more effective extraction of the printer ink from the ink cartridge 104.

Figure 4:
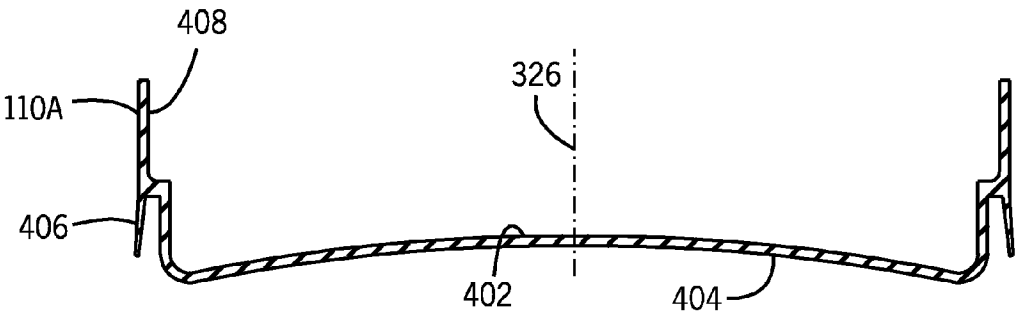
FIG. 4 is a cross-sectional view of a plunger for use in an ink cartridge, according to alternative implementations.

As noted above, FIG. 3 shows an example arrangement in which the mating surface 316 of the plunger 110 is generally planar. In alternative implementations, as depicted in FIG. 4, a plunger 110A can have a different shape. The mating surface 402 (upper surface) of the plunger 110A is convex (when viewed from the top of the plunger 110A). The convex mating surface 402 has a profile that generally matches the concave profile of the bottom surface 314 of the drive head 106 shown in FIG. 3.

The plunger 110A has a bottom surface 404 (the surface that contacts the printer ink in the ink cartridge 104) that is generally concave when viewed from the bottom of the plunger 110A. The curved profile of the bottom portion of the plunger 110A allows for enhanced extraction of printer ink from the ink cartridge 104, since the curved profile can provide a squeeze action due to pressure applied inwardly towards the center line 326.

As further shown in FIG. 4, the plunger 110A has a sealing lip 406 that is to sealingly engage the inner wall of the ink cartridge outer housing 302. As with the plunger 110 shown in FIG. 3, the plunger 110A also defines a receptacle 408 in which the drive head 106 of the FIG. 3 can be received.

Figure 5:
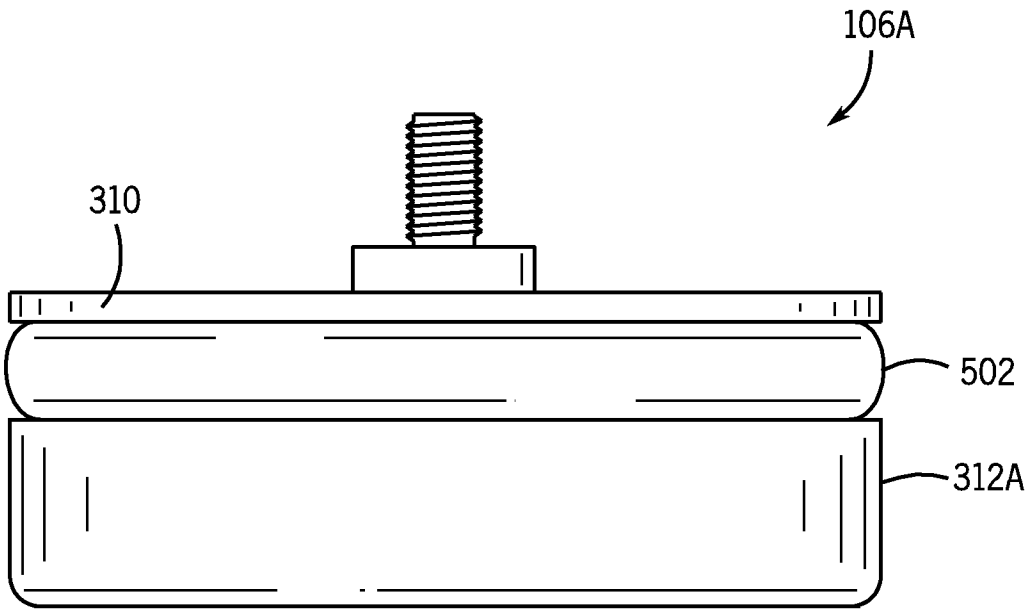
FIG. 5 is a side view of a drive ahead in a drive assembly according to further implementations.

FIG. 5 depicts a drive head 106A according to alternative implementations. The drive head 106A has the rigid core 310 (similar to the rigid core 310 of FIG. 3). The drive head 106A further has an O-ring seal 502 and a gasket 312A. The O-ring seal 502 and the gasket 312A can be formed of different materials (such as different elastomers), or can be formed of the same material. In arrangements using the drive head 106A, the outward radial force (322 shown in FIG. 3) applied by the drive head 106A (against the plunger 110 shown in FIG. 3 for example) is applied by the O-ring 502 instead of by the gasket 312A. The bottom surface of the gasket 312A can be concave-shaped, similar to the bottom surface 314 of the gasket 312 of FIG. 3.

By using drive heads and plungers according to various implementations discussed, effective and uniform extraction of relatively viscous printer ink can be achieved. The drive head and plunger designs allows for improved sealing engagement between the plunger and the ink cartridge housing inner wall (such as due to the outward radial force 322 depicted in FIG. 3), which can result in reduced ink accumulation on the ink cartridge housing inner wall. Additionally, the squeeze action provided by a concave shape of a bottom surface of the drive head allows for increased extraction of printer ink from the ink cartridge, which leads to more efficient use of the printer ink. Also, in some examples, due to use of a relatively soft material (such as elastomer) in the drive head and/or plunger, improved pressure distribution on the plunger's bottom surface is provided, which eliminates or reduces stress concentrations and plunger failures. Also, this latter feature enhances the cartridge reliability, and also allows a thinner plunger to be used, which can reduced cartridge cost.

In the foregoing description, numerous details are set forth to provide an understanding of the subject disclosed herein. However, implementations may be practiced without some or all of these details. Other implementations may include modifications and variations from the details discussed above. It is intended that the appended claims cover such modifications and variations.

What is claimed is:

1. A printer system comprising:

a drive assembly having a moveable drive head, the drive head to engage a plunger in an ink cartridge containing printer ink, wherein movement of the drive head is to cause corresponding movement of the plunger to extract the printer ink from the ink cartridge, wherein the drive head has a bottom surface that is concave, the bottom surface to engage the plunger to move the plunger; and an ink delivery assembly to deliver the extracted printer ink to a substrate for printing.

2. The printer system of claim 1, wherein the drive head has a rigid core and a gasket attached to the rigid core, and wherein the concave bottom surface is part of the gasket.

3. The printer system of claim 2, wherein the gasket is formed of a material that contains an elastomer.

4. The printer system of claim 2, where the drive head further has an O-ring seal between a portion of the rigid core and the gasket.

5. The printer system of claim 1, wherein the plunger has a receptacle to receive at least a portion of the drive head.

6. The printer system of claim 1, wherein a surface of the plunger for mating with the concave drive head bottom surface is convex.

7. The printer system of claim 1, wherein a surface of the plunger for mating with the concave drive head bottom surface is generally planar.

8. The printer system of claim 1, wherein the printer ink contained in the ink cartridge includes solid color particles suspended in a liquid.

9. The printer system of claim 1, wherein the drive assembly includes a piston moveable by pneumatic pressure, and wherein the drive head is moveable by movement of the piston.

10. The printer system of claim 1, wherein the drive head has an initial position in which the drive head is disengaged and separated from the plunger, and wherein the drive head is actuatable to move from the initial position to a second position in which the drive head is engaged with the plunger to cause sliding movement of the plunger in a housing of the ink cartridge.

11. A drive assembly comprising:

an actuating member moveable by an input force; and a drive head moveable in response to movement of the actuating member, wherein the drive head has an engagement surface that is concave in shape, the concave engagement surface for engaging a plunger in a cartridge containing a liquid in which solid particles are suspended, the drive head to move the plunger to extract the liquid containing suspended solid particles from the cartridge.

12. The drive assembly of claim 11, wherein the drive head includes a rigid core and a gasket attached to the rigid core, wherein the concave engagement surface is part of the gasket.

13. The drive assembly of claim 12, wherein the gasket is formed of a material that contains elastomer.

14. The drive assembly of claim 11, further comprising a drive rod connected to the actuating member and the drive head.

15. The drive assembly of claim 11, wherein the actuating member is a piston moveable by input pressure.

16. The drive assembly of claim 11, wherein the drive head is to impart an outward radial force against a sealing lip of the plunger to improve sealing engagement between the sealing lip and a wall of the cartridge, and wherein the sealing lip of the plunger slides against the wall of the cartridge as the drive head moves the plunger inside the ink cartridge.

17. The drive assembly of claim 11, wherein the drive head has an initial position in which the drive head is disengaged and separated from the plunger, and wherein the drive head is actuatable to move from the initial position to a second position in which the drive head is engaged with the plunger to cause sliding movement of the plunger in a housing of the cartridge.

18. A cartridge comprising:

a container having a nozzle, the container containing a liquid in which solid particles are suspended, the liquid to be delivered through the nozzle to a system; and a moveable plunger in the container, the plunger having a convex mating surface for engagement to a concave engagement surface of a drive head of a drive assembly in the printer system, where the plunger is moveable by the drive head to extract the liquid containing suspended solid particles from the container.

19. The cartridge of claim 18, wherein the plunger has a sealing lip to engage an inner wall of the container.

20. The cartridge of claim 18, wherein the plunger is formed of a material that contains elastomer.

21. The cartridge of claim 18, wherein the plunger has a receptacle to receive at least a portion of the drive head, wherein an upper surface of a bottom of the receptacle has a convex shape to match the concave engagement surface of the drive head.

* * * * *